US005474471A

United States Patent [19]

Tanaka

[11] Patent Number: 5,474,471

[45] Date of Patent: Dec. 12, 1995

[54] SLEEVE FOR INSULATING SOLDERLESS TERMINAL

[75] Inventor: Shinzo Tanaka, Tokyo, Japan

[73] Assignee: Tokyo Dipp Co., Ltd., Tokyo, Japan

[21] Appl. No.: 384,432

[22] Filed: Jan. 31, 1995

Related U.S. Application Data

[63] Continuation of Ser. No. 121,787, Sep. 15, 1993, abandoned.

[30] Foreign Application Priority Data

Oct. 4, 1992 [JP] Japan ..... 4-35433

[51] Int. Cl.[6] ..... H01R 13/40

[52] U.S. Cl. ..... 439/596

[58] Field of Search ..... 439/596, 521, 439/686, 701, 881, 892, 730, 718, 694

[56] References Cited

U.S. PATENT DOCUMENTS

| | | | |
|---|---|---|---|
| 3,332,053 | 7/1967 | Busler | 439/596 |
| 4,342,494 | 8/1982 | Normann et al. | 439/596 |
| 4,418,978 | 12/1983 | Shamir | 439/596 |
| 4,679,884 | 7/1987 | Klemp | 439/596 |
| 4,767,361 | 8/1988 | Hoshino et al. | 439/596 |
| 5,106,326 | 4/1992 | Tsuji et al. | 439/596 |

*Primary Examiner*—Gary F. Paumen
*Assistant Examiner*—Hien D. Vu
*Attorney, Agent, or Firm*—Burgess, Ryan & Wayne

[57] ABSTRACT

An electrical connector having a sleeve for insulating a solderless terminal having a rear end which covers an electrical lead extending substantially perpendicular to the terminal and a solderless connection between the lead end and the terminal. The sleeve comprises a body with a first and a second sidewall, a leaf hingedly connected to the first sidewall at the rear end of the sleeve and at least one resilient hook means arranged at an end of the leaf opposite to the hinged connection. The hook means has a projection at a free end to engage a hole in the second sidewall to insure that the leaf covers the rear end of the sleeve and the projection engages the hole in the second sidewall.

3 Claims, 3 Drawing Sheets

SLEEVE FOR INSULATING SOLDERLESS TERMINAL

This application is a continuation, of application Ser. No. 08/121,787, filed Sep. 15, 1993, now abandoned.

BACKGROUND OF THE INVENTION

This invention relates to the construction of an electrical connector having a sleeve for insulating solderless terminals connected to electric circuits and leads therein by applying mechanical pressure without the use of solder.

FIG. 1 shows a conventional insulating sleeve 1 covering a solderless terminal 2 connected to a lead 3 extending substantially perpendicular to the frame of the solderless terminal, at (a) and (b). As is illustrated, the rear end of the insulating sleeve 1 protecting the lead 3 and a connecting member 4 between the lead and the solderless terminal consists of a leaf 11 and a leaf 12 that are hingedly connected to opposite walls of the body of the sleeve that covers the leading end of the terminal and the vicinity thereof. The rearmost portions of the upper and lower leaves 11 and 12 are bent to form the rear-end wall of the sleeve when closed. The solderless terminal 2 and lead 3 are inserted into the insulating sleeve 1 by opening the leaves 11 and 12 hingedly connected to the sleeve 1. When the inserted solderless terminal 2 and lead 3 are in position, the sleeve 1 is closed by fitting a projection 17 formed on the bent free end of either leaf in a hole 18 provided on the mating end of the other leaf.

However, the conventional insulating sleeve having two openable leaves 11 and 12 as described above induces considerable complexity not only in its manufacturing process but also in its use.

When, in addition, the upper and lower leaves are closed, the free bent ends thereof must be substantially flush with each other. To fulfill this requirement, the projection 17 and hole 18 protrude from the free ends of the upper and lower leaves as shown at (b) in FIG. 1, thus sacrificing the simplicity in the manufacturing process and reuse.

The object of this invention is to obviate the aforementioned shortcomings of the conventional insulating sleeve by providing a new insulating sleeve that is not only easy to open and close but also facilitates the removal of the terminal therefrom when the need arises.

SUMMARY OF THE INVENTION

To achieve the object described above, an insulating sleeve of this invention, which protects a solderless terminal and a lead extending substantially perpendicular to the frame of the terminal, has an unbent leaf hingedly connected to a wall of the body of the sleeve, forming the rear-end wall of the sleeve when closed, with a hook having an elastic projection provided at the free end thereof away from the hingedly connected end and projection on the hook adapted to fit in a hole in a wall opposite the wall of the body of the sleeve to which the leaf is hingedly connected, of the sleeve from inside thereof.

DETAILED DESCRIPTION OF THE INVENTION

The operational principle of this invention is described below.

Figure 1A:
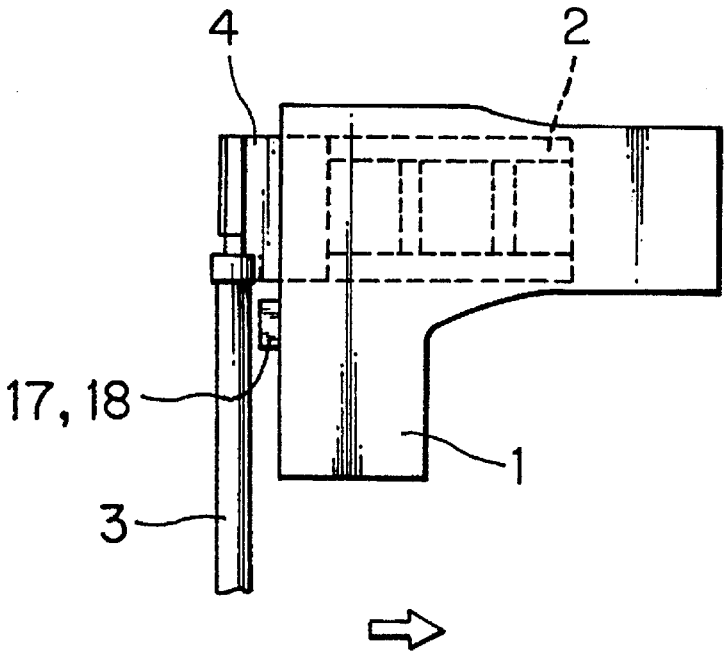
FIG. 1(a) (PRIOR ART)
FIG. 1 shows a plan view and a cross-sectional side elevation, at (a) and (b) of a conventional insulating sleeve, with a lead and a solderless terminal half inserted therein.
Figure 1B:
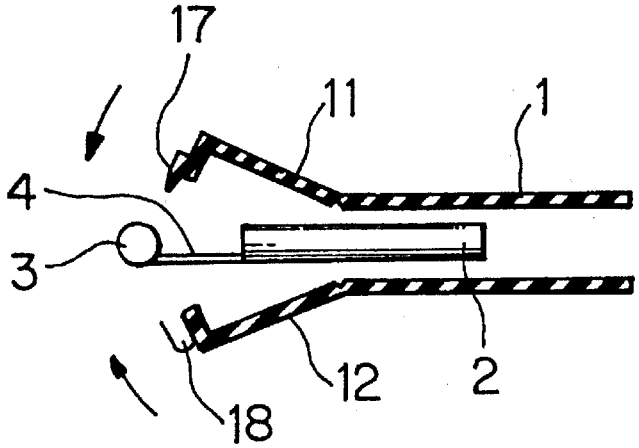
FIG. 1(b) (PRIOR ART)
Figure 2A:
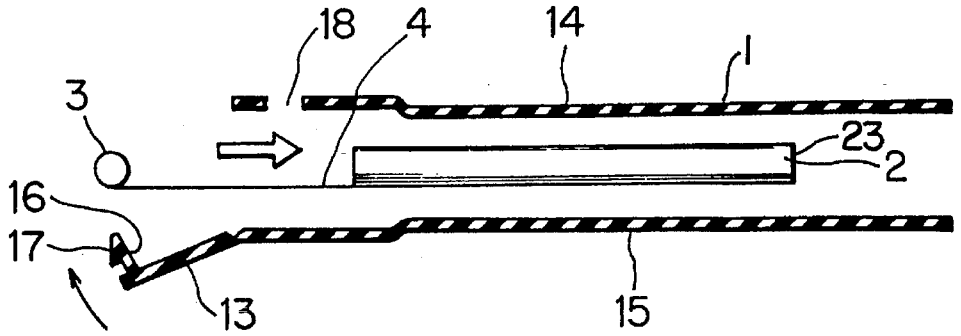
FIG. 2 shows cross-sectional side elevations of an insulating sleeve according to this invention, with (a) and (b) showing a condition in which a lead and a solderless terminal are half inserted therein and a condition in which they have been completely inserted, and (c) showing the projection on the hook depressed by a needle for removal of the solderless terminal.
Figure 2B:
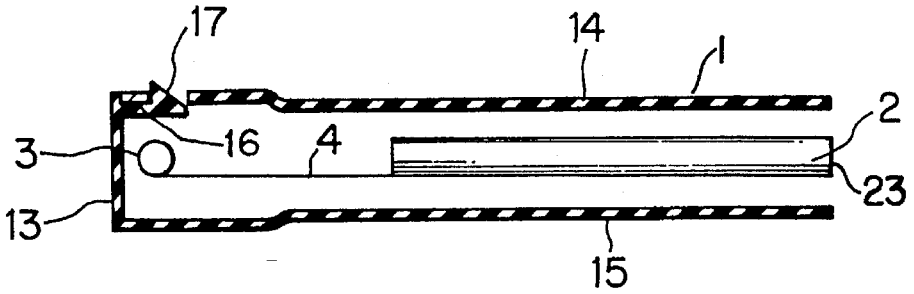
Figure 2C:
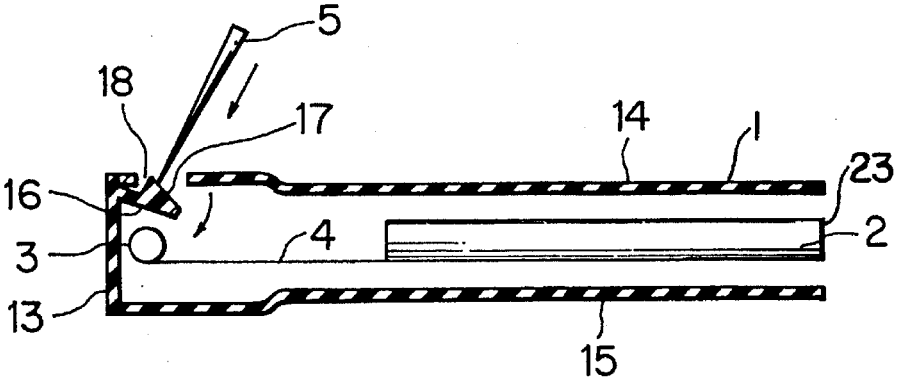

A side elevation of FIG. 2(*a*) shows a solderless terminal 2 whose frame 21 intersects at right angles with a lead 3 at the point the connection is inserted into a sleeve 1. As is obvious from this figure, a rear-end leaf 13 of the sleeve is hingedly connected to the wall 15 of the sleeve and is shown opened to permit the insertion of the solderless terminal 2 and the lead 3 connected thereto.

When the insertion is complete, the rear-end leaf 13 is fastened to the wall 14 of the sleeve by fitting a projection 17 on a hook 16 provided on the rear-end leaf 13 into a hole 18 in the wall 14 from inside shovel, as shown at FIG. 2(*b*), whereby the solderless terminal 2 and lead 3 are securely contained in the insulating sleeve 1.

When the need arises to take the solderless terminal 2 and lead 3 out of the insulating sleeve 1, the rear-end leaf 13 is released from the wall 14 by depressing the projection 17 with a needle 5, as shown at FIG. 2(*c*). Being made of resilient plastic, the rear-end leaf 13 the insulating sleeve can be easily inserted in and released from the hole 18.

Before entering the hole 18, the projection 17 slides forward in contact with the inner surface of the wall 14 as shown at FIG. 2(*b*). Therefore, the projection 17 should preferably be shaped so as to insure smooth sliding over the inner surface of the wall 14 and smooth entry into the hole 18.

Figure 3:
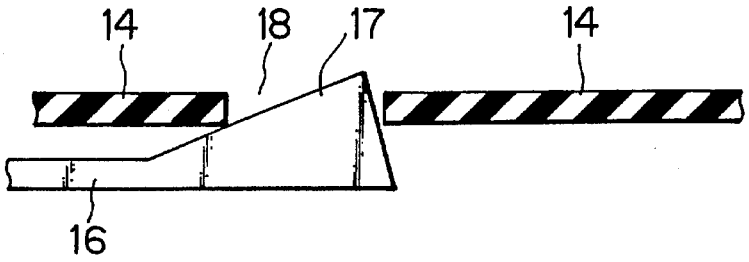
FIG. 3 is a cross-sectional side elevation of a preferred embodiment of this invention.
Figure 4:
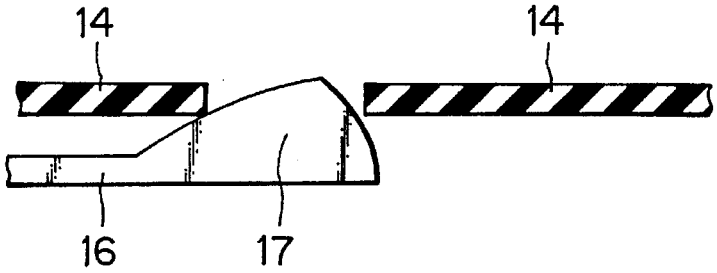
FIG. 4 is a cross-sectional side elevation of another preferred embodiment of this invention.

FIG. 3 shows a projection 17 whose cross-sectional shape is substantially triangular, whereas FIG. 4 shows a projection 17 whose cross-sectional shape consists of a combination of arcs.

Figure 5:
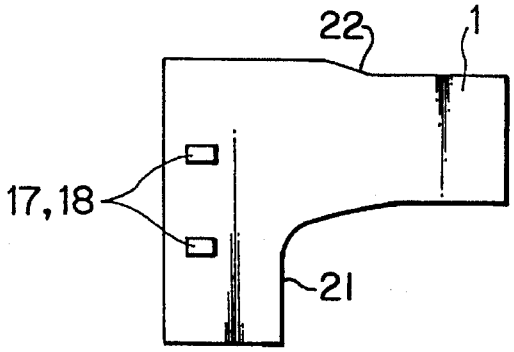
FIGS. 5 and 6 are plan views showing the shape of sleeves according to this invention.
Figure 6:
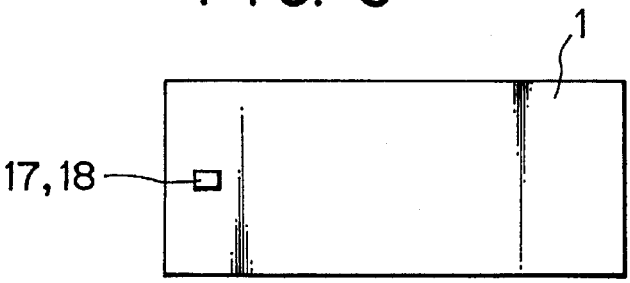

The sleeve 1 which comprise the rear-end leaf 13 having the hook 16 and projection 17 thereon may have various shapes. FIG. 5 shows an L-shaped sleeve, with a part 21 to cover the lead 3 and its connection with the frame and a part 22 to substantially cover the connector end 23 of the solderless terminal 2 and the part 21 and the part 22 intersecting at right angles to each other in a plan view. FIG. 6 shows another sleeve that is substantially rectangular in a plan view.

Usually one or two projections 17 and the corresponding number of holes 18 are provided, though the number is not specifically limited.

While a combination of one projection 17 and one hole 18 is simple and the rear-end leaf 13 can be released by depressing only one projection 17 as shown at FIG. 2(*c*), a combination of two or more projections 17 and holes 18 provides a more secure engagement.

In an insulating sleeve of this invention, as is shown above, the rear-end leaf 13 alone, instead of two facing leaves as in the conventional sleeve described before, opens and closes with respect to either the top or bottom wall thereof. In addition, the small projection 17 on the hook 16 not only easily engages with the hole 18 but also provides a smooth operation.

As shown in FIG. 2(*a*), 2(*b*) and 2(*c*) the rear-end leaf 13 is easily brought into engagement with the wall 14 by first bringing the hook 16 into contact with an inside surface of the wall 14 and then fitting the projection 17 on the hook 16 into the hole 18 in the wall 14. When the need arises to take the lead 3 and the solderless terminal out of the insulating sleeve, the rear-end leaf 13 can be easily opened by simply depressing the projection 17 on the hook 16 with a needle 5.

While simple in design, the insulating sleeve of this invention is superior to the conventional ones in many respects.

What is claimed is:

1. An electrical connector comprising:

an insulative sleeve having a rear end removably enclosing and adapted to receive therethrough an electrical lead extending substantially perpendicular to a solderless terminal and a solderless connection connecting a lead end of said electrical lead and the solderless terminal a body with a first sidewall and a second sidewall, said first and second sidewalls removably enclosing said solderless terminal when said rear end encloses said electrical lead and said solderless connection, and said first and second sidewalls being in fixed relation to each other at all times, a leaf connected by a hinge to the first sidewall at the rear end of the sleeve, said leaf and rear portions of said first and second sidewalls forming said rear end of said sleeve, at least one hole in the second sidewall at the rear end of the sleeve, at least one resilient hook, arranged at an end of the leaf opposite to the hinge, having a projection at a free end, the leaf and hook being dimensioned such that the projection on the at least one resilient hook is arranged to engage the at least one hole in the second sidewall from an inside surface of the second sidewall, whereby the leaf covers the rear end of the sleeve when the projection on the at least resilient hook means engages the at least one hole in the second sidewall of the sleeve from the inside surface of the second sidewall.

2. The connector of claim 1, wherein the projection has a substantially triangular cross-sectional shape.

3. The connector of claim 1, wherein the projection has an arched cross-sectional shape.

* * * * *